US007381162B2

(12) United States Patent
Kuo

(10) Patent No.: US 7,381,162 B2
(45) Date of Patent: Jun. 3, 2008

(54) EXERCISER HAVING ADJUSTABLE SEAT

(76) Inventor: Hai Pin Kuo, No. 15, Lane 833, Wen Hsien Road, Tainan 70459 (TW)

( * ) Notice: Subject to any disclaimer, the term of this patent is extended or adjusted under 35 U.S.C. 154(b) by 826 days.

(21) Appl. No.: 10/947,475

(22) Filed: Sep. 22, 2004

(65) Prior Publication Data

US 2006/0234834 A1 Oct. 19, 2006

(51) Int. Cl.
*A63B 22/06* (2006.01)

(52) U.S. Cl. ..... 482/57; 482/908; 297/344.15

(58) Field of Classification Search ..... 482/51, 482/57, 62, 72, 95–97, 142, 148, 908; 601/23, 601/24, 32–36; 297/283.1, 283.2, 283.3, 297/344.15, 344.16; 128/845; 606/241, 606/242

See application file for complete search history.

(56) References Cited

U.S. PATENT DOCUMENTS 5,853,353 A * 12/1998 Blumel ..... 482/57
5,916,065 A * 6/1999 McBride et al. ..... 482/57
6,089,656 A 7/2000 Hals ..... 297/215.13
6,482,133 B1 * 11/2002 Miehlich ..... 482/72
6,565,487 B1 5/2003 Kuo ..... 482/57
7,294,096 B1 * 11/2007 Stearns ..... 482/140
2005/0239608 A1 * 10/2005 Somwong ..... 482/57

* cited by examiner

*Primary Examiner*—Loan H. Thanh
*Assistant Examiner*—Tam Nguyen
(74) *Attorney, Agent, or Firm*—Charles E. Baxley

(57) ABSTRACT

An exerciser includes a base, a parallelogrammic supporting device rotatably supported on the base, to allow the supporting device to be rotated and adjusted relative to the base to selected angular position, a seat device is disposed on the supporting device and adjustable relative to the base to selected position. The seat device includes a handle, an actuator coupled between the supporting device and the base, to adjustably support the supporting device and the seat device to the base. A hand grip is pivotally attached to the handle, and coupled to the actuator, to control the actuator, and to allow the users to operate the actuator without departing the seat device.

5 Claims, 6 Drawing Sheets

EXERCISER HAVING ADJUSTABLE SEAT

BACKGROUND OF THE INVENTION

1. Field of the Invention

The present invention relates to an exerciser, and more particularly to an exerciser having an adjustable seat for being easily adjusted by users.

2. Description of the Prior Art

Various kinds of typical exercisers, such as cycle exercisers have been developed and comprise a seat disposed thereon for supporting users. For allowing the users to be comfortably supported on the seat, various kinds of typical cushioning devices have been provided to cushion the seat, and thus to cushion the users.

For example, U.S. Pat. No. 6,089,656 to Hals discloses one of the typical cycle exercisers comprising a seat pivotally disposed or supported thereon with a parallelogrammic structure for supporting users, and a spring-biasing cushioning device disposed in the parallelogrammic structure for cushioning the seat and thus the users.

However, the parallelogrammic structure may not be solidly secured to the seat or to the other supporting bases, such that the seat may not be solidly secured to the supporting bases, and such that the users may not be stably supported on the supporting bases with the parallelogrammic structure.

The applicant has developed another typical cycle exerciser which has been allowed and issued as U.S. Pat. No. 6,565,487 to Kuo, and which also comprises a seat pivotally disposed or supported thereon with a parallelogrammic structure for supporting users, and a lock rod for locking the parallelogrammic structure to the supporting bases at any selected heights or positions.

However, when it is required to adjust the parallelogrammic structure to the supporting bases at the selected heights or positions, the users have to move away from the seat, and then have to actuate the lock rod and to move or adjust the parallelogrammic structure relative to the supporting bases to the required or selected heights or positions, and then to release the lock rod, to allow the lock rod to lock the parallelogrammic structure to the supporting bases at the required or selected heights or positions.

The cited typical cycle exercisers have no support devices to solidly support the parallelogrammic structure relative to the supporting bases at the required or selected heights or positions, and have no adjusting device for allowing the users to easily and readily adjust the parallelogrammic structure relative to the supporting bases to any required or selected heights or positions.

The present invention has arisen to mitigate and/or obviate the afore-described disadvantages of the conventional cycle exercisers.

SUMMARY OF THE INVENTION

The primary objective of the present invention is to provide an exerciser including an adjustable seat for being easily adjusted by users.

The other objective of the present invention is to provide an exerciser including an adjustable seat having a parallelogrammic structure that may be solidly supported relative to the supporting bases at any required or selected heights or positions.

In accordance with one aspect of the invention, there is provided an exerciser comprising a base, a parallelogrammic supporting device rotatably supported on the base, to allow the parallelogrammic supporting device to be rotated and adjusted relative to the base to selected angular position, a seat device disposed on the parallelogrammic supporting device, to allow the seat device to be adjusted relative to the base to selected position with the parallelogrammic supporting device, the seat device including a first handle disposed thereon, a first actuator coupled between the parallelogrammic supporting device and the base, to adjustably support the parallelogrammic supporting device and thus the seat device to the base at selected position, and a first hand grip pivotally attached to the first handle, and coupled to the first actuator, to control the first actuator to adjust the parallelogrammic supporting device and the seat device relative to the base, and for allowing users to operate the first actuator without departing the seat device.

The parallelogrammic supporting device includes two bars rotatably attached on the base with pivot axles, and a rod pivotally secured to upper portions of the bars with pivot pins, to form a parallelogrammic structure.

The seat device includes a sleeve slidably and adjustably disposed on the rod, to adjustably secure the seat device to the rod of the parallelogrammic supporting device. The seat device includes a seat member rotatably attached onto the sleeve with a pivot shaft, to allow the seat member to be rotated and adjusted relative to the sleeve to selected angular position.

The seat member includes an extension having a slot formed therein, to slidably receive a fastener which is extended from the sleeve, to limit a rotational movement of the seat member relative to the sleeve.

The seat device includes a pivotal seat back disposed thereon, and a second actuator coupled to the seat back, to adjust and to support the seat back relative to the seat device at selected angular positions. The seat back includes a plurality of orifices formed therein for air circulation purposes.

The seat device includes a second handle disposed thereon, a second hand grip pivotally attached to the second handle, and coupled to the second actuator, to control the second actuator to adjust the seat back relative to the seat device, and for allowing users to operate the second actuator without departing the seat device.

The seat device may also include a remote control device attached on the first handle, for controlling the first actuator. A post may further be provided and extended from the base, and a pair of foot pedals coupled to the post with cranks, for conducting cycle exercises.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
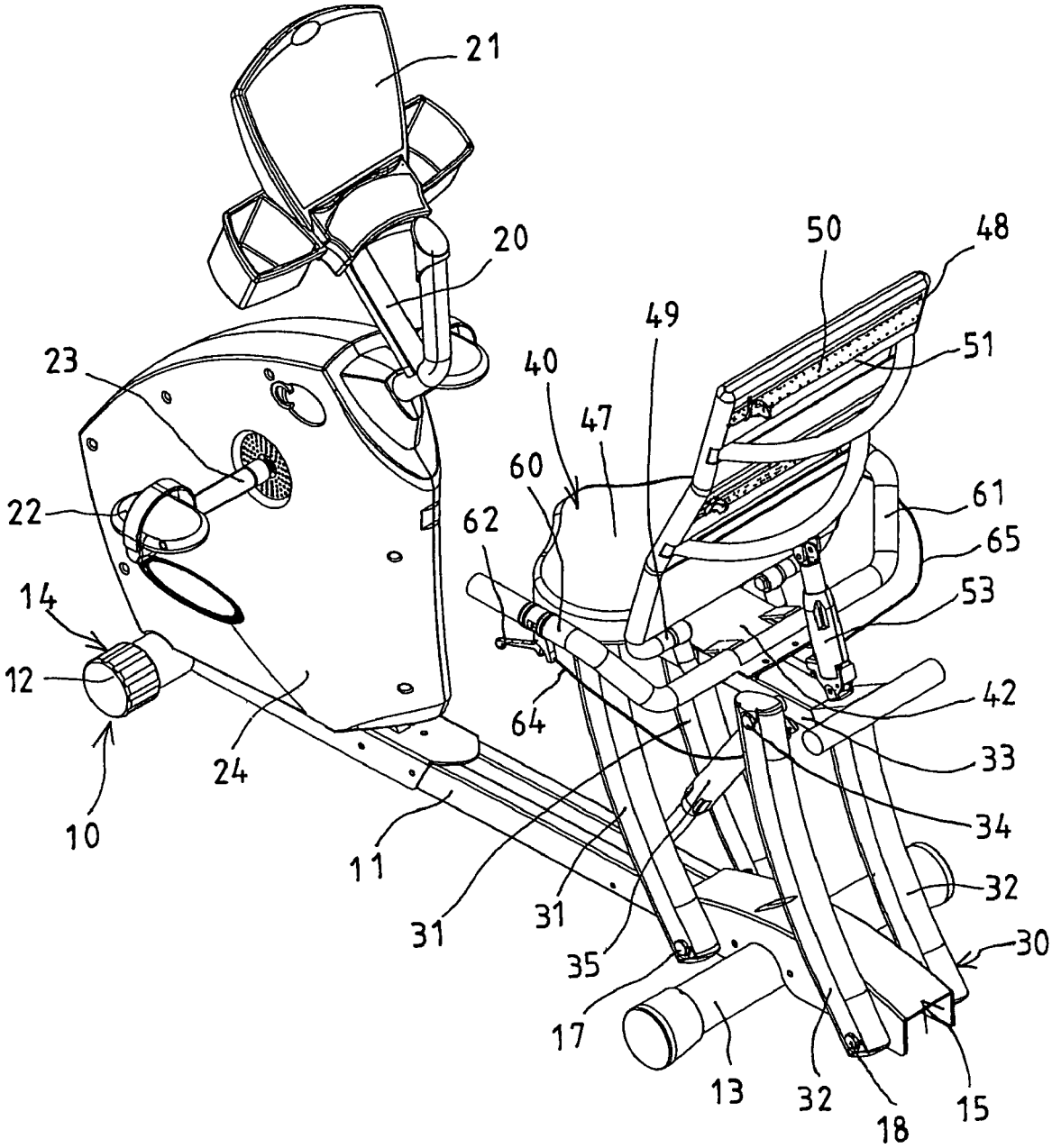
FIG. 1 is a rear perspective view of an exerciser in accordance with the present invention.
Figure 2:
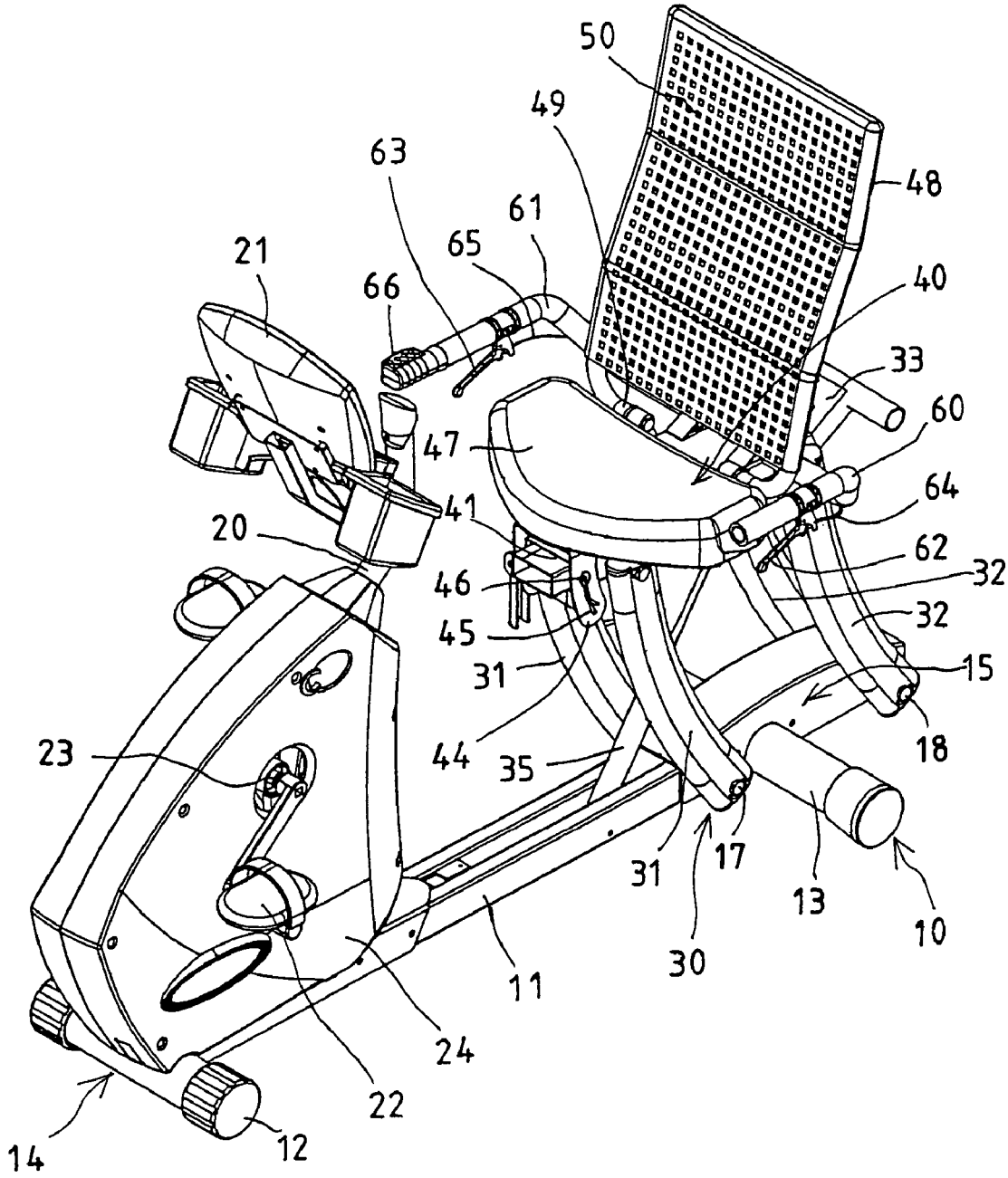
FIG. 2 is a front perspective view of the exerciser.
Figure 3:
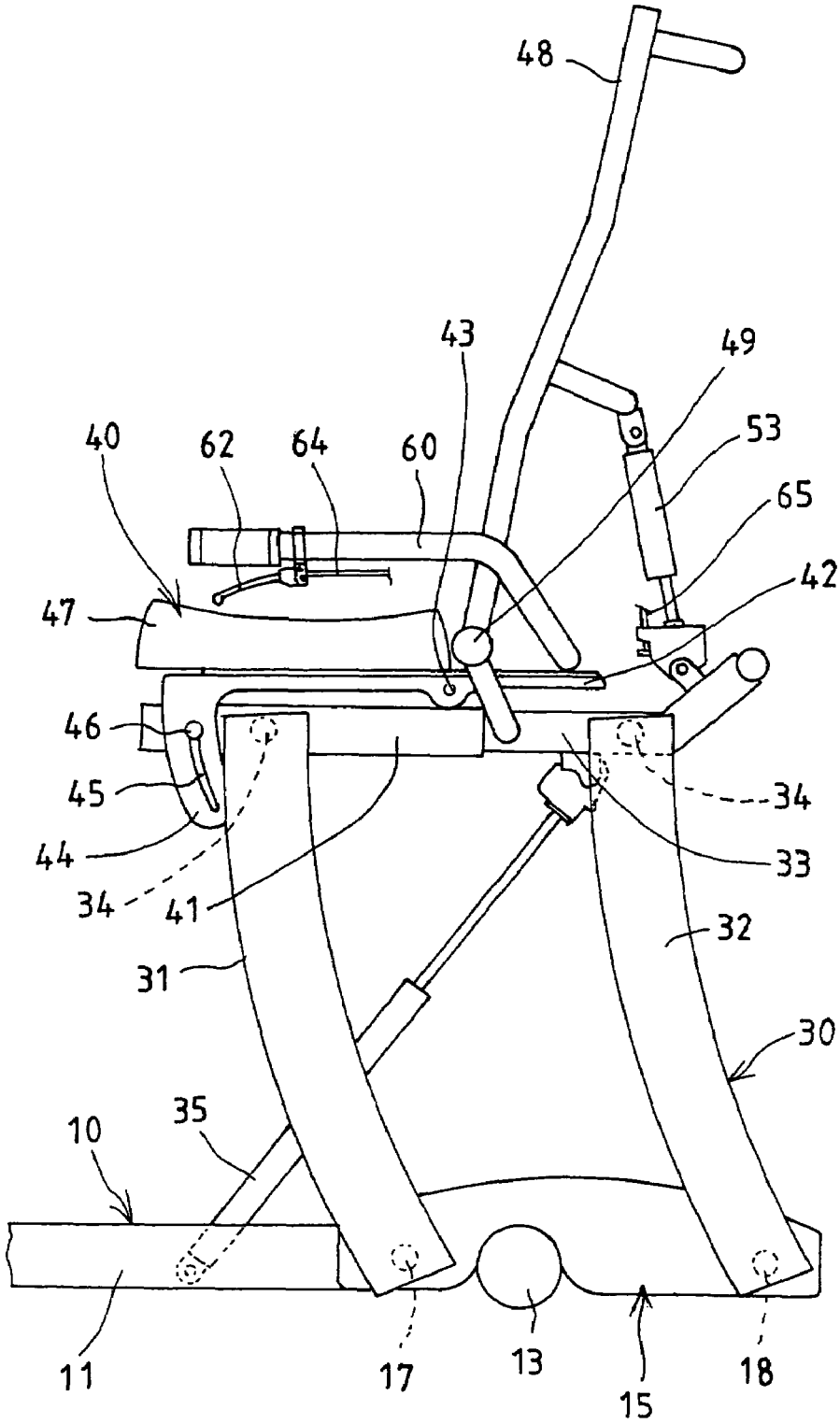
FIG. 3 is a side schematic view of the exerciser.
Figure 4:
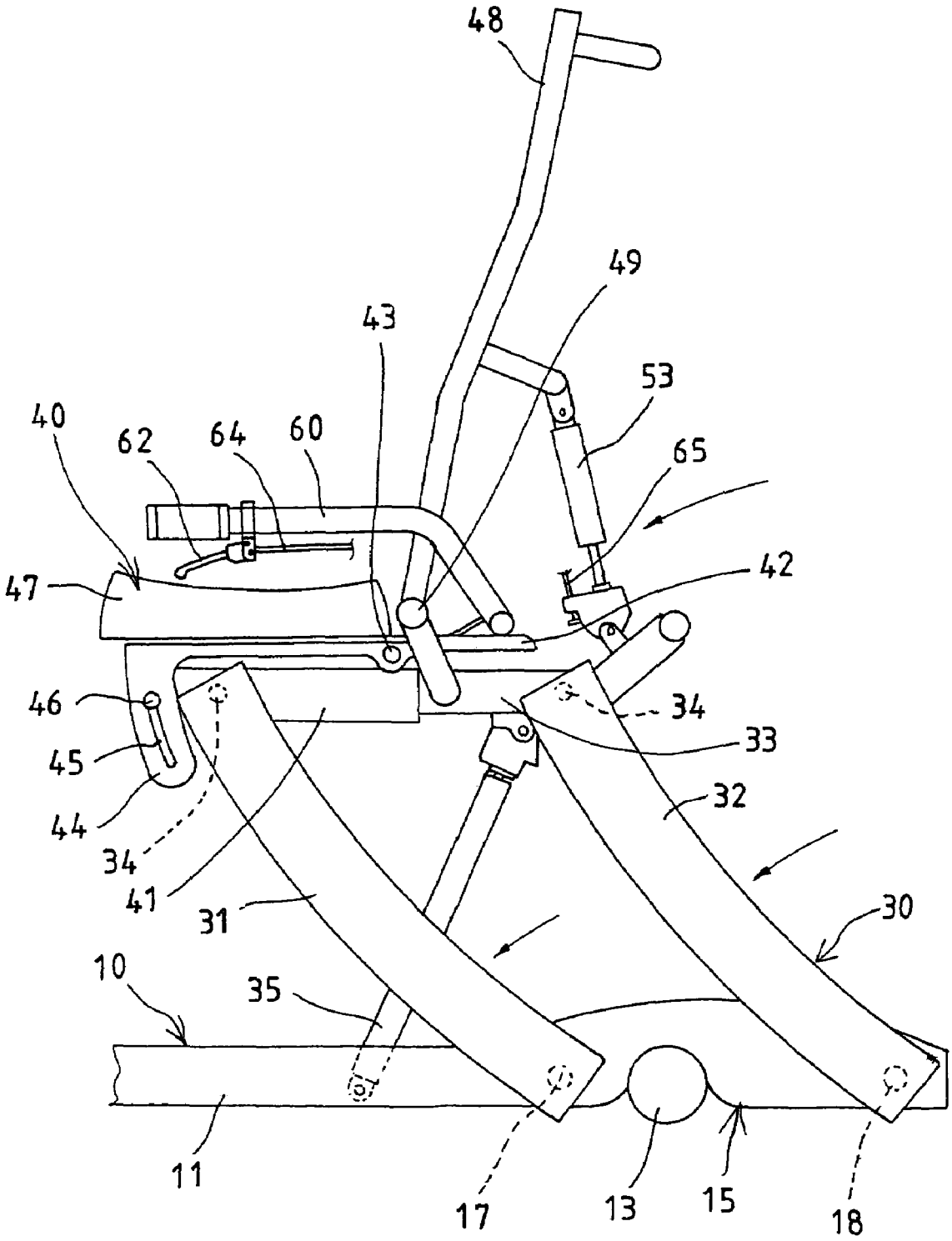
FIGS. 4, 5, 6 are side schematic views of the exerciser, similar to FIG. 3, illustrating the operation of the exerciser.

Referring to the drawings, and initially to FIGS. 1-3, an exerciser in accordance with the present invention comprises a base 10 including a longitudinal beam 11 having one or more lateral beams 12, 13 laterally attached to the front portion 14 and/or the rear portion 15 thereof, for increasing an area or a stability of the base 10, and for allowing the base 10 to be stably supported on ground or various supporting surfaces.

A post 20 is disposed on or extended upwardly from the front portion 14 of the base 10, and includes a display 21 or the like disposed thereon for showing various information of the exerciser, and includes a pair of foot pedals 22 coupled thereto with cranks 23, for allowing users to conduct cycle exercises. The cycling mechanism of the exerciser is typical and shielded within a housing 24, and will not be described in further details.

A parallelogrammic supporting device 30 includes one or more front bars 31 and one or more rear bars 32 each having a lower portion rotatably or pivotally secured to the rear portion 15 of the base 10 with a pivot axle 17, 18, and includes a rod 33 rotatably or pivotally secured to the upper portions of the bars 31, 32 with pivot pins 34, in order to form a parallelogrammic structure, and for allowing the parallelogrammic supporting device 30 to be rotated relative to the base 10, and to be adjusted forwardly and downwardly, or rearwardly and upwardly relative to the base 10.

An extendible or adjustable actuator 35, such as a bolt-and-tube adjusting device, a hydraulic or pneumatic cylinder, or the like, may further be provided and coupled between the base 10 and the parallelogrammic supporting device 30, such as the rod 33 of the supporting device 30, in order to adjust and to support the rod 33 of the supporting device 30 relative to the base 10 at any selected angular positions or heights. For example, the bolt-and-tube adjusting device may include a bolt and a tube threaded together and coupled between the base 10 and the supporting device 30, to adjust and to support the supporting device 30 relative to the base 10.

Figure 6:
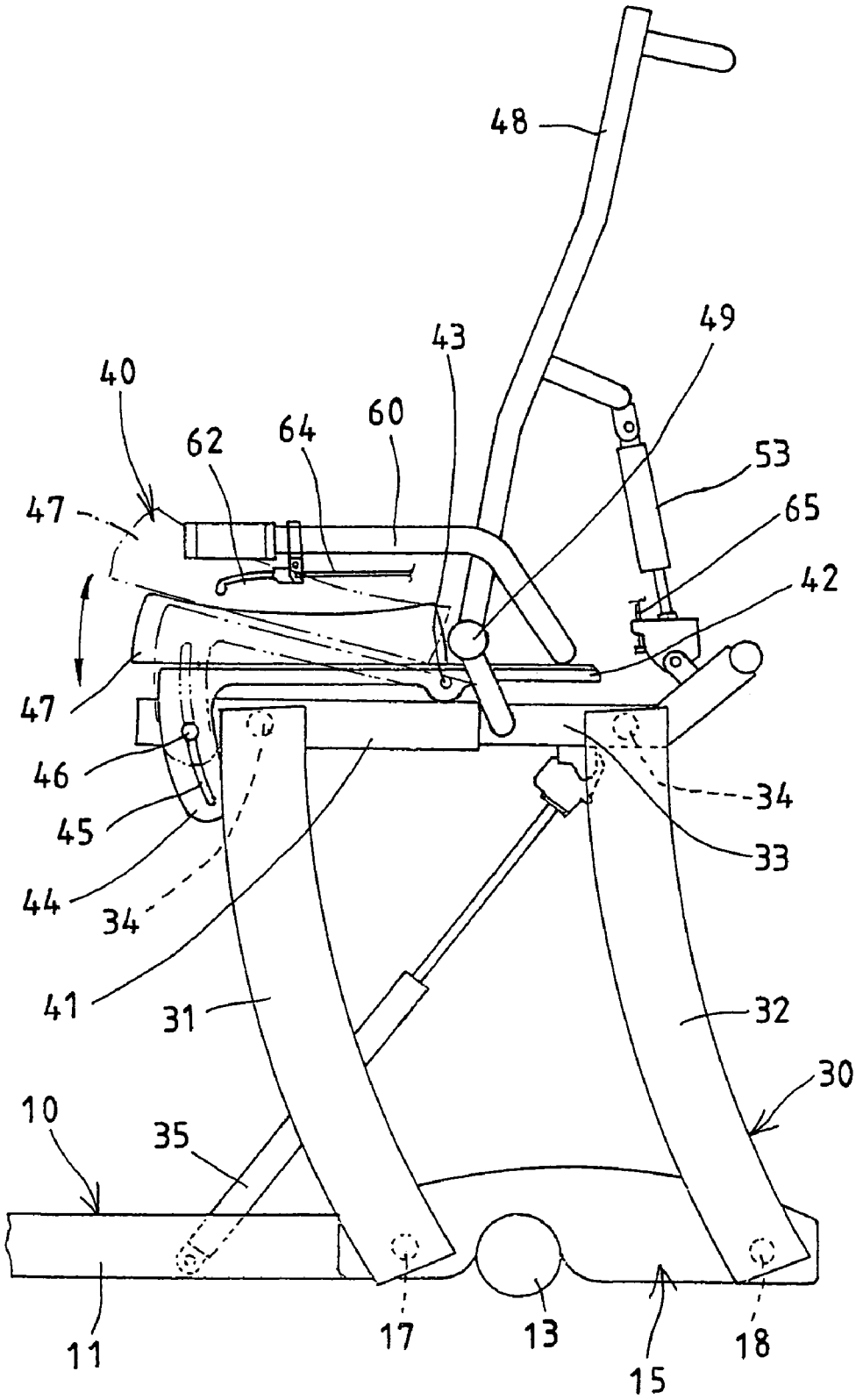

A seat device 40 includes a sleeve 41 slidably and adjustably attached onto the rod 33 of the parallelogrammic supporting device 30, and fixable to the rod 33 with fasteners or latches (not shown), for allowing the seat device 40 to be adjusted along the rod 33 of the parallelogrammic supporting device 30 to any selected position. The seat device 40 includes a seat member 42 pivotally or rotatably attached onto the sleeve 41 with a pivot shaft 43, for allowing the seat member 42 to be rotated or adjusted relative to the sleeve 41 to any selected angular position (FIG. 6).

The seat member 42 includes a front extension 44 having an oblong and/or curved slot 45 formed therein, to slidably receive a fastener 46 which is extended from the sleeve 41, in order to limit the rotational movement of the seat member 42 relative to the sleeve 41. The fastener 46 may secure the extension 44 of the seat member 42 to the sleeve 41, in order to adjustably secure the seat member 42 to the sleeve 41 to any selected angular position (FIG. 6). The seat member 42 includes a seat cushion 47 disposed thereon to comfortably support the users thereon.

Figure 5:
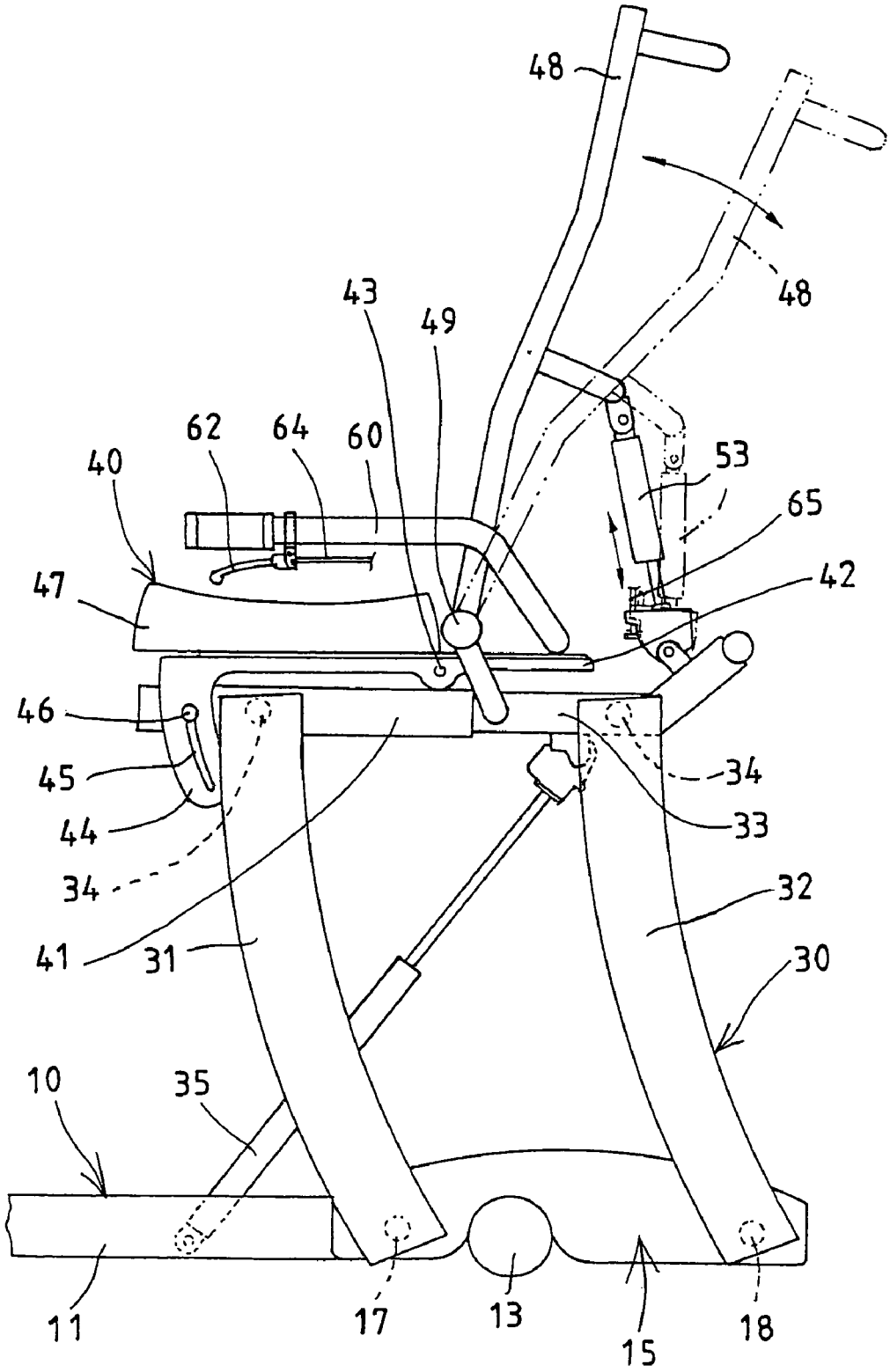

The seat device 40 includes a seat back 48 pivotally or rotatably disposed thereon, such as pivotally or rotatably attached to the seat member 42 with a pivot pole 49, to allow the seat back 48 to be rotated or adjusted relative to the seat member 42 or relative to the seat device 40 to any required or selected angular position (FIG. 5). The seat back 48 preferably includes a number of orifices 50 formed therein (FIGS. 1, 2) for air circulation purposes, and one or more pockets 51 attached thereto (FIG. 1) for receiving or storing various objects.

An extendible or adjustable actuator 53, such as a bolt-and-tube adjusting device, a hydraulic or pneumatic cylinder, or the like, may further be provided and coupled between the seat member 42 or the parallelogrammic supporting device 30, such as the rod 33 of the parallelogrammic supporting device 30, and the seat back 48, in order to adjust and to support the seat back 48 relative to the seat member 42 or the parallelogrammic supporting device 30 at any selected angular positions.

The seat device 40 may further include two handles 60, 61 disposed thereon, such as attached on the seat member 42, and two control hand grips 62, 63 pivotally attached to the handles 60, 61 respectively, and coupled to the actuators 35, 53 with cables 64, 65 respectively, in order to control the actuators 35, 53 respectively, and so as to adjust the seat device 40 and the parallelogrammic supporting device 30 relative to the base 10, and to adjust the seat back 48 relative to the seat member 42 or the seat device 40 respectively.

It is to be noted that the control hand grips 62, 63 are pivotally attached to the handles 60, 61 and may thus be easily and readily operated or actuated by the hands of the users that hold or grasp the handles 60, 61 respectively, such that the users may actuate the actuators 35, 53 to adjust the seat device 40 relative to the base 10, and to adjust the seat back 48 relative to the seat member 42 without departing from the seat device 40.

As shown in FIG. 2, a remote control device 66 may further be provided, or selectively attached to one of the handles 60, 61, for allowing the users to actuate the actuators 35, 53 to adjust the seat device 40 relative to the base 10, and to adjust the seat back 48 relative to the seat member 42 remotely, and without departing from the seat device 40.

Accordingly, the exerciser in accordance with the present invention includes an adjustable seat for being easily adjusted by users, and having a parallelogrammic structure that may be solidly supported relative to the supporting bases at any required or selected heights or positions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base having a longitudinal beam extending from a front lateral beam to a rear lateral beam;

a post extending upwardly from said base, and a pair of foot pedals coupled to said post with cranks to allow for circular motion cycling exercise;

a supporting assembly rotatably and adjustably supported on said base at selected angular positions of varying heights relative to said base;

a seat device, adapted for a user to sit thereon, disposed on said supporting assembly, to allow said seat device to be adjustable relative to said base at selected angular positions along with said supporting assembly, said seat device including a first handle disposed thereon;

a first actuator coupled between said supporting assembly and said base, to adjustably support said supporting assembly and thus said seat device relative to said base at selected angular positions; and a first hand grip pivotally attached to said first handle, and coupled to said first actuator to control said first actuator to adjust said supporting assembly and said seat device relative to said base, and for allowing a user seated on said seat device to operate said first actuator without the user having to depart from said seat device wherein said supporting assembly includes:

at least two bars rotatably attached on said base parallel to each other with pivot axles, and a rod pivotally secured to upper portions of said bars with pivot pins to form an adjustable parallelogrammic structure; and the seat device includes:

a sleeve slidably and adjustably disposed on said rod to adjustably secure said seat device to said rod of said parallelogrammic supporting assembly, and a seat member rotatably attached onto said sleeve with a pivot shaft to allow said seat member to be rotated angularly and adjustably upward relative to said sleeve wherein the seat member includes an extension having a slot formed therein, to slidably receive a fastener which is extended from said sleeve to limit rotational movement of said seat member relative to said sleeve.

2. The exerciser as claimed in claim 1, wherein said seat device includes a pivotal seat back disposed thereon, and a second actuator coupled to said seat back, to adjust and to support said seat back relative to said seat device at selected angular positions.

3. The exerciser as claimed in claim 2, wherein said seat back includes a plurality of orifices formed therein for air circulation purposes.

4. The exerciser as claimed in claim 2, wherein said seat device includes a second handle disposed thereon, a second hand grip pivotally attached to said second handle, and coupled to said second actuator, to control said second actuator to adjust said seat back relative to said seat device, and for allowing said user, when seated on said seat device, to operate said second actuator without departing said seat device.

5. The exerciser as claimed in claim 1, wherein said seat device includes a remote control device attached on said first handle, for controlling said first actuator.

* * * * *